United States Patent [19]

Hüsgen et al.

[11] Patent Number: 4,766,350

[45] Date of Patent: Aug. 23, 1988

[54] ELECTRIC CIRCUIT WITH TRANSIENT VOLTAGE DOUBLING FOR IMPROVED OPERATION OF A DISCHARGE LAMP

[75] Inventors: Theo Hüsgen, Aachen, Fed. Rep. of Germany; Hubert Raets, Nieuwenhagen, Netherlands; Gerd Schiefer, Aachen, Fed. Rep. of Germany; Jan Zwier, Eindhoven, Netherlands

[73] Assignee: U.S. Philips Corporation, New York, N.Y.

[21] Appl. No.: 416,722

[22] Filed: Sep. 10, 1982

[30] Foreign Application Priority Data

Sep. 11, 1981 [NL] Netherlands ..... 8104200

[51] Int. Cl.[4] ..... H05B 41/36

[52] U.S. Cl. ..... 315/207; 315/DIG. 7; 315/290; 315/224; 315/307; 315/199; 315/106

[58] Field of Search ..... 315/106, 194, 199, 207, 315/208, 224, 287, 290, 307, DIG. 7, 209, DIG. 5

[56] References Cited

U.S. PATENT DOCUMENTS

| | | | |
|---|---|---|---|
| 3,422,309 | 1/1969 | Spira et al. | 315/194 |
| 3,890,537 | 6/1975 | Park et al. | 315/287 X |
| 3,919,592 | 11/1975 | Gray | 315/208 X |
| 4,009,099 | 7/1978 | Grudelback | 315/DIG. 7 |
| 4,121,136 | 10/1978 | Fournier et al. | 315/DIG. 7 |
| 4,167,689 | 9/1979 | Quirke | 315/DIG. 7 |
| 4,168,453 | 9/1979 | Gerhard et al. | 315/DIG. 7 |
| 4,291,254 | 9/1981 | Arlt et al. | 315/287 X |
| 4,398,126 | 8/1983 | Zuchtriegel | 315/209 R |

*Primary Examiner*—David K. Moore
*Assistant Examiner*—Michael Razaui
*Attorney, Agent, or Firm*—Thomas A. Briody; David R. Treacy; Bernard Franzblau

[57] ABSTRACT

The invention relates to an electric arrangement for operating a an electric discharge lamp (13) which is connected in series with a coil (14) and a switch (15) to a pulsatory direct voltage source. The combination of the lamp and the coil is shunted by a rectifier. The lamp is shunted by a capacitor (18) and the switch is periodically rendered conductive at an instant when the instantaneous voltage of the pulsatory direct voltage source is between 0.5 and 0.8 times the then required re-ignition voltage of the lamp. The voltage build up across the capacitor (18) after the switch has become conducting causes the lamp to reignite. The luminous efficacy of the lamp is comparatively high.

18 Claims, 2 Drawing Sheets

Figure 1:
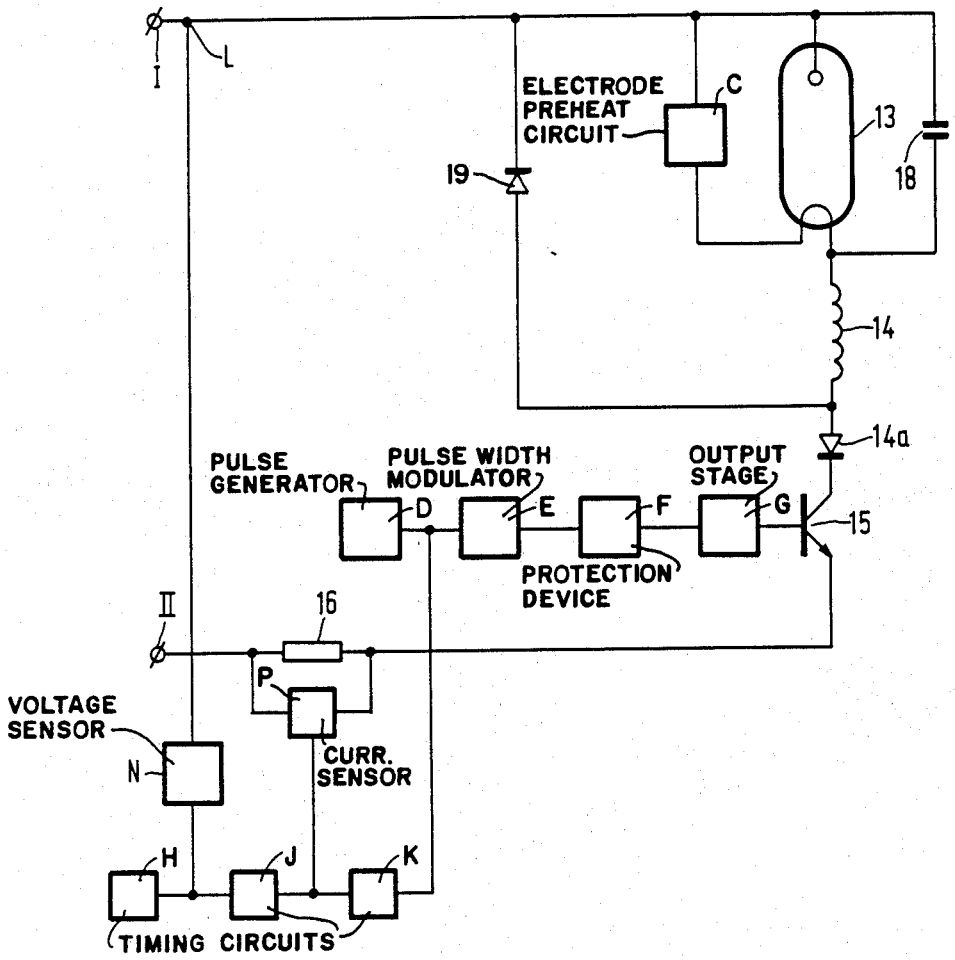

ELECTRIC CIRCUIT WITH TRANSIENT VOLTAGE DOUBLING FOR IMPROVED OPERATION OF A DISCHARGE LAMP

The invention relates to an electric circuit arrangement for operating a gas and/or vapour discharge lamp forming part of said arrangement. The circuit arrangement is provided with two input terminals, for connection to a supply source which supplies a pulsatory direct voltage, the form of which corresponds to that of a voltage obtained from a sinusoidal alternating voltage by a substantially unsmoothed full-wave rectifier. The, input terminals are connected to each other by a series-combination of at least the discharge lamp, a coil, and a controlled semiconductor switch. A part of this series-combination which includes the lamp and excludes the semiconductor switch is shunted by a first rectifier. A control circuit switches the semiconductor switch several times during each period of the pulsatory direct voltage.

A known electric circuit arrangement of the said kind is described, for example, in the U.S. Pat. No. 3,890.537. Such a supply circuit is sometimes designated as a forward converter.

A disadvantage of this known electric circuit arrangement is that during the time intervals in which the instantaneous voltage between the input terminals has a small value, a small current is required to be maintained through the lamp. Another disadvantage is that the re-ignition of the lamp takes place only after a comparatively long time (dark period) has elapsed i.e. it takes a long time for the instantaneous voltage across the lamp to increase to the then required re-ignition voltage of the lamp. The small current to be maintained in the lamp in fact requires a means for temporarily storing a charge. A long dark period generally leads to a comparatively low luminous efficacy of a lamp. The luminous efficacy is expressed, for example, in lumen per Watt.

The invention has for an object to provide an electric circuit arrangement of the kind mentioned in the preamble, which, without producing a small current through the lamp—during the time intervals in which the instantaneous voltage between the input terminals has a small value—nevertheless effects a comparatively rapid re-ignition of the lamp.

An electric circuit arrangement according to the invention for operating a gas and/or vapour discharge lamp comprises two input terminals, for connection to a supply source which supplies a pulsatory direct voltage, the form of which corresponds to that of a voltage obtained from a sinusoidal alternating voltage by a substantially unsmoothed full-wave rectifier. The input terminals are connected to each other by a series-combination of at least the discharge lamp, a coil and a controlled semiconductor switch. A part of this series-combination which includes the lamp and excludes the semiconductor switch is shunted by a first rectifier. A control circuit switches the semiconductor switch several times during each period of the pulsatory direct voltage. The invention is characterized in that the discharge lamp is shunted by a capacitor, and in that in the operating condition the control circuit switches off the semiconductor switch at each minimum voltage occurrence of the pulsatory direct voltage and renders it conductive only when the instantaneous voltage across the input terminals both amounts to 0.5 to 0.8 times the then required re-ignition voltage of the lamp and exceeds the operating voltage of the lamp.

An advantage of this electric circuit arrangement is that a small current is no longer required to flow through the lamp during the time intervals in which the instantaneous voltage between the input terminals is low and that, nevertheless, the re-ignition of the lamp is effected rapidly. The latter advantage means a short dark period and consequently a large luminous efficacy.

The following details are given by way of explanation. When the lamp is shunted by a capacitor, it is achieved that, when (after a zero value of the voltage between the input terminals) the controlled semiconductor switch—connected in series with the lamp—is rendered conductive again, a transient phenomenon occurs which, due to the combined action of this capacitor and the coil, causes the instantaneous voltage across the capacitor, and hence the instantaneous voltage across the lamp, to build up to nearly twice the instantaneous input voltage. Therefore, if the instant at which the controlled semiconductor switch is rendered conductive is chosen such that the instantaneous voltage across the input terminals exceeds 0.5 times the then required lamp re-ignition voltage, the said voltage build-up brings about the re-ignition. If the controlled semiconductor switch is not rendered conductive until an instant at which the instantaneous voltage has exceeded 0.8 times the then required re-ignition voltage, the dark period has already become comparatively long and hence the luminous efficacy is low. The voltage across the input terminals—at the instant at which the semiconductor switch is rendered conductive—should be larger than the operating voltage of the lamp because otherwise the lamp immediately extinguishes after the re-ignition.

It should be noted that it is known per se from the German "Offenlegungsschrift" No. 2,155,205 to arrange a capacitor parallel to a discharge lamp and to arrange a coil in series with this lamp. In this case, however, the lamp is not connected in series with a controlled semiconductor switch which, in given parts of each period of the input voltage is rendered conductive. The aforementioned (periodic) transient phenomenon therefore does not occur.

In an arrangement according to the invention the controlled semiconductor switch is switched several times in the time interval between the re-ignition of the lamp and the next minimum voltage occurrence (zero value). Also, in the non-conducting state of this switch, current then flows through the lamp, namely through the first rectifier.

The first ignition of the discharge lamp after the application of the voltage between the input terminals of the circuit is effected, for example, by means of a separate auxiliary device forming a part of the circuit.

In a preferred embodiment of an electric circuit arrangement according to the invention, the control circuit is constructed so that for the first ignition of the lamp, it renders conductive the semiconductor switch substantially at a maximum instantaneous value of the pulsatory direct voltage.

An advantage of this preferred embodiment is that a separate auxiliary device is not required for supplying a high voltage to the lamp for the first ignition. When the semiconductor switch is rendered conductive at substantially the peak voltage of the pulsatory direct voltage, a transient effect occurs which produces a rapid build-up of the voltage across the lamp to approximately twice the said peak voltage due to the combined action of the coil and the capacitor. The lamp can then ignite.

Subsequently, the program according to which the semiconductor switch becomes conducting and non-conducting will pass to that of the operating condition.

The discharge lamp may be provided, for example, with electrodes of a non-preheatable type.

In an improvement of the said preferred embodiment of an electric circuit arrangement according to the invention, in which the lamp is provided with a preheatable electrode acting as a cathode, the lamp is shunted by a second controlled semiconductor switch which is connected to an end of the cathode remote from the input terminals. The control circuits of the two semiconductor switches are arranged to make the two semiconductor switches conductive for the preheating of the lamp electrode prior to the first ignition of the lamp.

An advantage of this improvement is that, when use is made of conventional discharge lamps provided with a preheatable electrode, this electrode can be preheated in a simple manner—through the second controlled semiconductor switch. Thus, the life of such a lamp is lengthened.

The procedure for igniting the lamp in the case of the said improvement is that the first step—after the electric circuit arrangement has been switched on—consists in making the first and second semiconductor switches conductive. This leads to the preheating of the cathode. Subsequently, the first semiconductor switch and hence also the second semiconductor switch are rendered non-conducting. The first semiconductor switch is then rendered conductive in the manner already indicated to produce nearly double the peak input voltage across the lamp. Finally, the rhythm in which the first semiconductor switch is controlled—after the ignition of the lamp—is adapted to the operating condition.

In a further improvement of the said preferred embodiment of a circuit according to the invention, a second rectifier is included in the series-combination including the lamp.

An advantage of this further improvement is that the substantially double peak voltage for the first ignition of the lamp is now applied across the lamp for a longer period of time, also in the case of a small—or parasitic—capacitance between the input terminals. This second rectifier prevents a further oscillation in the circuit comprising the capacitor and the coil after this substantially double peak voltage has been reached. Thus, the ignition is promoted.

In a further preferred embodiment of an electric circuit arrangement according to the invention, the lamp is a low-pressure mercury vapour discharge lamp of a substantially circular cross-section, the outer diameter of which is at most 26 mm.

An advantage of this preferred embodiment is that a high gain in luminous efficacy is then obtained with respect to the situation in which no capacitor was arranged parallel to the lamp. Due to the comparatively small diameter of the indicated lamp, a strong de-ionisation occurs in this lamp during a dark period so that the reqired re-ignition voltage increases rapidly. Therefore, without the capacitor and the control of the semiconductor switch of the invention, it would take a comparatively long time before the instantaneous input voltage became equal to this large required re-ignition voltage. As a result, the dark period would then be long so that the luminous efficacy would have a low value.

An embodiment of the invention will now be described with reference to the accompanying drawings.

Figure 2:
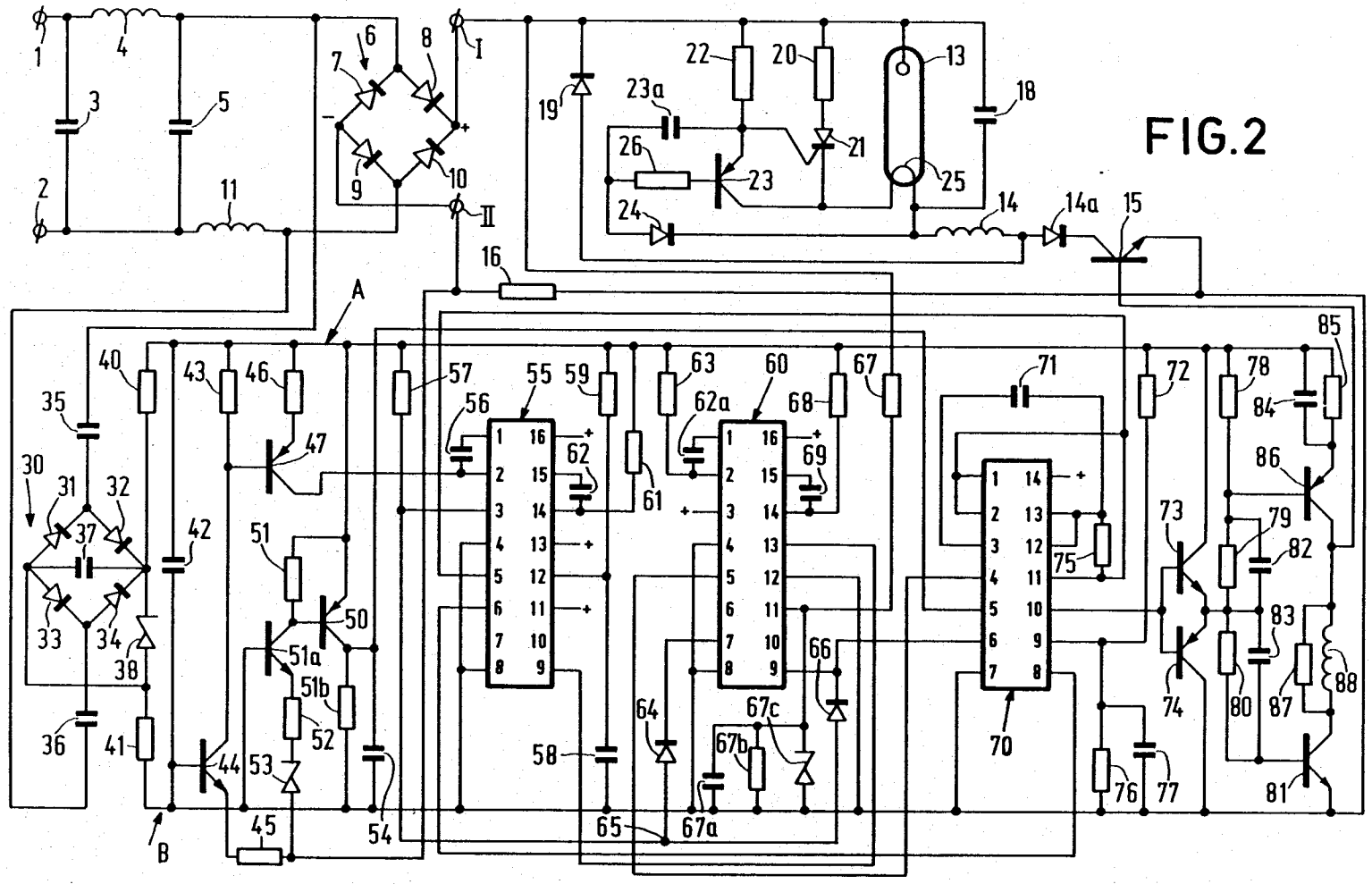

In the drawings:

FIG. 1 shows mainly a block diagram of a circuit arrangement, according to the invention, for igniting and operating a low-pressure discharge lamp forming a part of said arrangement; and FIG. 2 shows in detail an electric circuit diagram of the arrangement of FIG. 1.

FIG. 2 further illustrates a full-wave rectifying device to which are connected two input terminals of the circuit arrangement according to the invention.

In FIG. 1, reference numerals I and II denote input terminals which are to be connected to a pulsatory direct voltage obtained from a sinusoidal alternating voltage by a substantially unsmoothed full-wave rectification.

The terminal I is connected to the terminal II through a series-combination of a discharge lamp 13, a coil 14, a diode 14*a*, a first semiconductor switch 15, and a measuring resistor 16. The lamp 13 is shunted by a capacitor 18 and by a device C comprising a second semiconductor switch. The lamp 13 with the coil 14 is shunted by a first rectifier 19.

A control circuit of the transistor 15 comprises a generator D of rectangular pulses. The generator D has connected to it a pulse width modulator E. F denotes a protection device. The block G accommodates the output stage of the control circuit by means of which the transistor 15 is rendered conductive and non-conductive.

Three timing circuits H, J and K control the transistor 15 in a desired rhythm in the various conditions of the lamp 13. Through the tapping L and a block N, the instantaneous input voltage is also taken into account. Through tappings across the measuring resistor 16 and via the block P the instantaneous current through the lamp 13 is taken into account. Auxiliary circuits for supplying the auxiliary direct voltage to the various blocks D, E, F, G, H, J and K are not shown in FIG. 1.

FIG. 2 shows in detail the circuit diagram. Corresponding reference numerals of FIGS. 1 and 2 designate the same circuit elements.

In FIG. 2, reference numerals 1 and 2 denote input terminals which are to be connected to an AC voltage of approximately 220 V, 50 Hz. The terminals 1 and 2 are connected to each other through a capacitor 3. The terminals 1 and 2 are also connected to each other through a series-combination of a coil 4 and a capacitor 5. A junction point between the coil 4 and the capacitor 5 is connected to a first rectifier bridge 6 which is provided with four diodes 7 to 10 inclusive (full-wave rectifying device). The input terminal 2 is connected through a coil 11 to another input terminal of the rectifier bridge 6. An output terminal I of the rectifier bridge 6 is connected through a series-combination comprising a low-pressure mercury vapour discharge lamp 13, a coil 14, a diode 14*a*, a first controlled semiconductor switch 15 and a resistor 16 to another output terminal II of the rectifier bridge 6. The connection of the input terminals 1 and 2 to the rectifier bridge 6 and the connection of the output terminals of this bridge through the just mentioned series-combination constitute the main current circuit of this electric arrangement. The lamp 13, of approximately 15 W, has a circular cross-section, the outer diameter of which is eleven mm. This outer diameter is therefore smaller than 26 mm.

The discharge lamp 13 is shunted by a capacitor 18. A first rectifier 19 is connected parallel to the series-combination of the lamp 13 and the coil 14. The lamp 13 is shunted by a series-combination of a resistor 20 and a second controlled semiconductor switch 21. The lamp 13 is further shunted by a series-combination of a resistor 22 and a transistor 23. A tapping point between the resistor 22 and the transistor 23 is connected to a control electrode of the second controlled semiconductor switch 21. This junction point is also connected through a capacitor 23*a* in series with a diode 24 to a junction point between a preheatable electrode (cathode) 25 of the lamp 13 and the coil 14. A junction point between the capacitor 23*a* and the diode 24 is connected through a resistor 26 to the base of the transistor 23.

The remaining part of the circuit arrangement constitutes the control circuit of the transistor 15. This control circuit is supplied through a second rectifier bridge 30 which is made up of four diodes 31 to 34 inclusive. A junction point between the coil 4 and the rectifier bridge 6 is connected through a capacitor 35 to an input terminal of the rectifier bridge 30. A junction point between the coil 11 and the rectifier bridge 6 is connected through a capacitor 36 to a second input terminal of the rectifier bridge 30. Two output terminals of the rectifier bridge 30 are connected to each other through a capacitor 37 and also through a Zener diode 38. An output terminal of the rectifier bridge 30 is further connected to a resistor 40. The other side of this resistor 40 is connected to a continuous conductor A. The other output terminal of the rectifier bridge 30 is connected to a resistor 41. The other side of this resistor 41 is connected to a continous conductor B. The conductors A and B are connected to each other through a large number of connections, first through a capacitor 42. There is also present a series-combination of a resistor 43 and a transistor 44. The emitter electrode of the transistor 44 is connected through a resistor 45 to a junction point between the resistor 16, in the main current circuit, and the output terminal II of the rectifier bridge 6. A junction point between the resistor 16 and the transistor 15 is connected to the continous conductor B of the control circuit of the transistor 15. The resistor 16 acts as a measuring resistor. The conductor A has further connected to it a resistor 46, the other side of which is connected to the emitter of a transistor 47. The base of the transistor 47 is connected to a junction point between the resistor 43 and the transistor 44. The collector of the transistor 47 is connected to a terminal 2 of an "integrated circuit" (IC) 55 of the Philips type no. 4528. Between the conductors A and B there is also situated a series-combination of a transistor 50 and a resistor 51*b*. The emitter and the base of the transistor 50 are connected to each other through a resistor 51. The base of the transistor 50 is further connected to the collector of a transistor 51*a*. The base of the transistor 51*a* is connected to the continuous conductor B. The emitter of the transistor 51*a* is connected through a series-combination of a resistor 52 and a Zener diode 53 to a junction point between the resistor 45 and the terminal II. The collector of the transistor 50 is further connected to a capacitor 54. The other side of this capacitor is connected to the continuous conductor B. The terminal 1 of IC 55 is connected through a capacitor 56 to the terminal 2 of this IC. The terminal 3 of IC 55 is connected through a resistor 57 to the continous conductor A. The terminal 4 is connected in the continous conductor B. The terminal 5 of IC 55 is connected to a further integrated circuit 70, in this case to the terminals 1, 2 and 11 of the latter IC. The terminal 6 of IC 55 is connected to the terminal 8 of IC 70. IC 70 is of the Philips type 4093. The terminal 8 of IC 55 is connected to terminal 4 of IC 55. The terminal 9 of IC 55 is connected to terminal 13 of an IC 60. The terminals 11, 13 and 16 of IC 55 are connected to a positive direct voltage of approximately 10 volt (not shown). The terminal 12 of IC 55 is connected through a capacitor 58 to the continuous conductor B. This terminal 12 is further connected through a resistor 59 to the continuous conductor A. The terminal 14 is connected through a resistor 61 to the continuous conductor A. The terminals 14 and 15 of IC 55 are connected to each other through a capacitor 62. The terminals 1 and 2 of the IC 60 are connected to each other through a capacitor 62*a*. IC 60 is of the same type as IC 55. The terminal 2 is also connected through a resistor 63 to the continuous conductor A. The terminals 3 and 16 of IC 60 are connected to a positive direct voltage of approximately 10 volt (not shown). The terminal 4 of IC 60 is connected to the continous conductor B. The terminal 5 of IC 60 is connected to the terminal 4 of IC 70. The terminal 7 of IC 60 is connected through a diode 64 to a junction point 65, the point 65 being located on a connection from the terminal 3 of IC 55, through a diode 66, to the terminal 6 of IC 70. The terminal 9 of IC 60 is connected to a point between the diode 66 and the terminal 6 of IC 70. The terminal 11 of IC 60 is connected to a resistor 67, the other side of which is connected between the terminal I and the lamp 13 in the main current circuit. The terminal 11 of IC 60 is further connected through a parallel-combination of a capacitor 67*a*, a resistor 67*b* and a Zener diode 67*c* to the conductor B. The terminal 12 of IC 60 is connected to the continous conductor B. The terminal 14 of IC 60 is connected to a resistor 68, the other side of which is connected to the continuous conductor A. The terminals 14 and 15 of IC 60 are further connected to each other through a capacitor 69.

The terminal 3 of IC 70 is connected through a capacitor 71 to the terminal 13. The terminal 7 of IC 70 is connected to the continous conductor B. The terminal 9 of IC 70 is connected through a resistor 72 to the continuous conductor A. The terminal 10 of IC 70 is connected to the bases of two transistors 73 and 74. The terminals 11 and 13 of IC 70 are connected to each other through a resistor 75. The terminals 12 and 13 of IC 70 are interconnected. The terminal 14 of IC 70 is connected to a direct voltage of approximately 10 volt (not shown). The terminal 9 of IC 70 is further connected to a parallel-combination of a resistor 76 and a capacitor 77. The other side of this parallel-combination is connected to the continuous conductor B. The transistors 73 and 74 are connected in series with each other and constitute a connection between the continous conductors A and B. There is further present a series-combination of three resistors 78, 79 and 80, which is connected on the one hand to the continuous conductor A and on the other hand to the base of a transistor 81. A junction point between the resistors 79 and 80 is connected to a junction between the emitters of the transistors 73 and 74. The resistor 79 is shunted by a capacitor 82. The resistor 80 is shunted by a capacitor 83. Finally, the continuous conductor A has connected to it a parallel-combination of a capacitor 84 and a resistor 85. The other side of this parallel-combination is connected to the emitter of a transistor 86. The base of this transistor is connected to a junction point between the resistors 78 and 79. The collector of the transistor 86 is connected to a parallel-combination of a resistor 87 and a coil 88. The other side of this parallel-combination is connected to the collector of the transistor 81. The emitter of the transistor 81 is connected to the continuous conductor B. A junction point between the collector of the transistor 86 and the coil 88 is connected to the base of the transistor 15. The control of this transistor 15 is realized through the latter connection.

It should be noted that the connections of the terminals 9 to 16 inclusive of IC 55 constitute a timing circuit for realizing a period duration of half a second. This corresponds to the block H of FIG. 1. The connections of the terminals 1 to 8 inclusive of IC 60 are associated with a timing circuit for realizing a period duration of approximately 4 msec. This corresponds to the block J of FIG. 1. The remaining terminals, i.e. 9 to 16 inclusive, of this IC 60 are associated with a timing circuit for realizing a period duration of approximately 1 msec. This corresponds to the block K of FIG. 1.

The connections of the terminals 1 to 3 inclusive and of 11 to 13 inclusive of IC 70 correspond to the block D of FIG. 1. The connections of the terminals 1 to 8 inclusive of IC 55 correspond to the block E of FIG. 1. The terminals 8 to 10 inclusive of IC 70 correspond to the block F of FIG. 1. The output stage of the control circuit 73 and 74, and 78 to 88 inclusive corresponds to the block G of FIG. 1. This output stage is connected to the base of the transistor 15.

The operation of the circuit described is as follows. After the input terminals 1 and 2 have been connected to the voltage source of approximately 220 volt, 50 Hz, the oscillator D is made operative, and the timing circuit H is started. The function of H is to cut off for half a second the two other timing circuits J and K. During this half second, the oscillator D (approximately 50 kHz) supplies through the blocks E to G inclusive a control signal to the transistor 15, which as a result is periodically switched. This charges the capacitor **23*a* so that the thyristor 21 is triggered. Consequently, current flows in the circuit 20, 21, 25, 14*a* 15. Thus, a preheating of the cathode 25** is obtained.

After the said half second, the timing circuit J will be made operative at every next minimum value of the input voltage between the terminals I and II. In this stage, in which the lamp 13 has not yet been ignited, the timing circuit K is triggered once at the trailing edge of the output pulse of the block J. As a result, the transistor 15 becomes non-conducting for 1 msec.

Due to the fact that in the meantime in the block C the transistor 23 has become conducting by the increase of the voltage across the cathode 25, the control signal of the thyristor 21 has disappeared. This thyristor 21 is then cut off due to the fact that, as stated above, the transistor 15 becomes non-conducting. This ends the preheating of the cathode 25.

After the pulse of one millisecond has ended, the transistor 15 is rendered conducting. At this instant ($4+1=5$ msec) after a minimum voltage occurrence of the voltage between terminals I and II), the instantaneous input voltage between the terminals I and II is substantially equal to the peak voltage thereof. The result is a transient phenomenon occurs at the instant transistor 15 is made conductive whereby the capacitor 18 is charged rapidly through the coil 14 to approximately twice the peak value of the input voltage at terminals I–II. This double voltage is also applied between the electrodes of the lamp 13. The lamp then ignites. It should be noted that with the use of the diode **14*a*** (second rectifier) it is avoided that the double voltage is applied across the lamp for too short a time.

The lamp 13 is now in the operating condition. The timing circuit K now starts at the leading edge of the 4 msec pulse. This results in the cut off of transistor 15 in the time interval between the instant of the minimum input voltage (between the terminals I and II) and the instant one millisecond thereafter. When the transistor then becomes conducting again, i.e. one millisecond after the zero crossing of the voltage between terminals I and II, a re-ignition voltage is supplied to the lamp. This occurs at an instant at which the voltage available between terminals I and II is between 0.5 and 0.8 times the required re-ignition voltage. In the present embodiment, the voltage available is approximately 0.6 times the required re-ignition voltage. At the instant transistor 15 is turned on, the transient effect involving coil 14 and capacitor 18 occurs. Voltage doubling by means of the coil 14 and the capacitor 18 occurs when transistor 15 conducts so that a voltage is obtained across the lamp which re-ignites this lamp in a reliable manner. The voltage available then already exceeds the operating voltage of approximately 60 Volts of the lamp 13.

In the time interval between the re-ignition of the lamp and the next following minimum voltage occurrence, the transistor 15 is switched at a frequency of approximately 50 kHz. Current then also flows through the lamp 13 in the non-conducting state of this transistor 15, in this case through the first rectifier 19.

In one embodiment, the circuit elements of the arrangement described had the following values:

| | |
|---|---|
| Capacitor 3 | approximately 0.33 μF |
| Capacitor 5 | approximately 0.33 μF |
| Capacitor 23a | approximately 33 nF |
| Capacitors 35 and 36 | approximately 0.33 μF |
| Capacitor 37 | approximately 10 μF |
| Capacitor 42 | approximately 22 μF |
| Capacitor 54 | approximately 10 nF |
| Capacitor 58 | approximately 1 nF |
| Capacitor 62 | approximately 100 nF |
| Capacitor 62a | approximately 1 nF |
| Capacitor 67a | approximately 100 pF |
| Capacitor 69 | approximately 330 pF |
| Capacitor 71 | approximately 10 pF |
| Capacitor 77 | approximately 10 nF |
| Capacitor 82 | approximately 100 pF |
| Capacitor 83 | approximately 3 nF |
| Capacitor 84 | approximately 10 nF |
| Coil 4 | approximately 22 μH |
| Coil 14 | approximately 7 mH |
| Coil 11 | approximately 200 μH |
| Coil 88 | aPProximately 10 μH |
| Resistor 20 | approximately 12Ω |
| Resistor 22 | approximately 100 kΩ |
| Resistor 16 | approximately 3.3Ω |
| Resistor 26 | approximately 470 kΩ |
| Resistor 40 | approximately 150Ω |
| Resistor 41 | approximately 150Ω |
| Resistor 43 | approximately 220 kΩ |
| Resistor 46 | approximately 1 kΩ |
| Resistor 51 | approximately 4.7 MΩ |
| Resistor 52 | approximately 10 kΩ |
| Resistor 57 | approximately 150 kΩ |
| Resistor 45 | approximately 100 kΩ |
| Resistor 59 | approximately 10 MΩ |
| Resistor 61 | approximately 8.2 MΩ |
| Resistor 63 | approximately 8.2 MΩ |
| Resistor 67a | approximately 680 kΩ |
| Resistor 67 | approximately 8.2 MΩ |
| Resistor 68 | approximately 4.7 MΩ |
| Resistor 72 | approximately 1.8 MΩ |
| Resistor 75 | approximately 680 kΩ |
| Resistor 76 | approximately 2.2 MΩ |

-continued

| | |
|---|---|
| Resistor 78 | approximately 6.8 KΩ |
| Resistor 79 | approximately 12 kΩ |
| Resistor 80 | approximately 8.2 KΩ |
| Resistor 85 | approximately 100Ω |
| Resistor 87 | approximately 270Ω. |

The luminous efficacy of the lamp 13 in the present case is approximately 50 lumen/Watt.

We claim:

1. An electric circuit arrangement for operating an electric discharge lamp comprising: two input terminals for connection to a supply source which supplies a pulsatory direct voltage of the form obtained from a sinusoidal alternating voltage via a substantially unsmoothed full-wave rectification, means connecting a series-combination of at least the discharge lamp, a coil, and a controlled semiconductor switch across said input terminals, a part of said series-combination which includes the lamp and excludes the semiconductor switch being shunted by a first rectifier, a control circuit coupled to a control electrode of the semiconductor switch for switching the semiconductor switch several times during each period of the pulsatory direct voltage, means coupling a capacitor in shunt with the discharge lamp, and wherein in the operating condition of the lamp the control circuit switches off the semiconductor switch at each minimum voltage occurrence of the pulsatory direct voltage and renders the semiconductor switch conductive only when the instantaneous voltage across the input terminals is 0.5 to 0.8 times the then required lamp re-ignition voltage and also exceeds the operating voltage of the lamp.

2. An electric circuit arrangement as claimed in claim 1, wherein to ignite the lamp, the control circuit includes timing circuit means for making the semiconductor switch conductive substantially at a maximum instantaneous value of the pulsatory direct voltage.

3. An electric circuit arrangement as claimed in claim 2, wherein the lamp includes a preheatable electrode acting as a cathode, a second controlled semiconductor switch connected in shunt with the lamp and to an end of the cathode remote from the input terminals, and a second control circuit coupled to the second semiconductor switch, said first and second control circuits being operative to trigger the two semiconductor switches into conduction for the preheating of the lamp electrode prior to the first ignition of the lamp.

4. An electric circuit arrangement as claimed in claims 2 or 3 further comprising a second rectifier connected in the series-combination including the lamp.

5. An electric circuit arrangement as claimed in claims 1 or 2 wherein the lamp is a low-pressure mercury vapour discharge lamp having a substantially circular cross-section and an outer diameter which is at most 26 mm.

6. A ballast circuit for starting and operating an electric discharge lamp comprising: a pair of input terminals for applying to the ballast circuit a pulsatory direct voltage derived from a full-wave rectified and unfiltered low frequency sinusoidal alternating voltage, an inductor, a controlled semiconductor switch, means for connecting a discharge lamp, said inductor and said semiconductor switch in a series circuit across said input terminals, a first rectifier connected in parallel with a part of said series circuit that includes the discharge lamp but excludes the semiconductor switch, a capacitor connected in parallel with the discharge lamp, and a control circuit coupled to the input terminals for supplying high-frequency switching pulses to a control electrode of the semiconductor switch thereby to switch the semiconductor switch a plurality of times during each period of the pulsatory direct voltage, and wherein the control circuit, in the operating condition of the lamp, switches the semiconductor switch off when the pulsatory direct voltage is at a minimum voltage level and switches the semiconductor switch on when the instantaneous voltage is at the input terminals is 0.5 to 0.8 times the required lamp reignition voltage and also exceeds the lamp operating voltage.

7. A ballast circuit as claimed in claim 6 further comprising a second rectifier connected in the series circuit including the lamp, the inductor and the semiconductor switch.

8. A ballast circuit as claimed in claim 7 wherein the first rectifier is connected in parallel with that part of the series circuit that includes the discharge lamp and the inductor and wherein said first and second rectifiers are oppositely polarized as seen from said input terminals.

9. A ballast circuit as claimed in claim 6 wherein the control circuit includes a timing circuit responsive to the voltage at the input terminals for allowing a switching pulse to be applied to the control electrode of the semiconductor switch to switch the semiconductor switch into conduction when the instantaneous value of the pulsatory direct voltage is a maximum, thereby to generate a high voltage across the capacitor sufficient to ignite the lamp.

10. A ballast circuit as claimed in claim 7 wherein the control circuit includes a timing circuit responsive to the voltage at the input terminals, the control circuit supplying, prior to lamp ignition, a switching pulse to the control electrode of the semiconductor switch to switch the semiconductor switch from cut-off into conduction when the instantaneous value of the pulsatory direct voltage is approximately a maximum, thereby to generate a high voltage across the capacitor sufficient to ignite the lamp.

11. A ballast circuit as claimed in claim 6 wherein the lamp includes a preheatable electrode, said circuit further comprising a second semiconductor switch connected in shunt with the lamp so as to form a preignition preheat current path across the input terminals that includes the first and second semiconductor switches, the inductor and the preheatable electrode.

12. A ballast circuit as claimed in claim 11 further comprising a second rectifier connected in the series circuit including the lamp, the inductor and the first semiconductor switch.

13. A ballast circuit as claimed in claim 6 wherein the control circuit includes a timing circuit responsive to the instantaneous lamp current.

14. A ballast circuit as claimed in claim 6 wherein the first rectifier is connected in parallel with that part of the series circuit that includes the discharge lamp and the inductor whereby, during the operating condition of the lamp, a current flows through the lamp via said first rectifier when the first semiconductor switch is switched off.

15. A ballast circuit as claimed in claim 6 wherein the control circuit includes a timing circuit responsive to the voltage at the input terminals, the control circuit supplying, prior to lamp ignition, a switching pulse to switch the semiconductor switch into conduction when the instantaneous value of the pulsatory direct voltage is a maximum, thereby to generate an ignition voltage across the capacitor of approximately twice the peak value of the pulsatory direct voltage so as to ignite the lamp.

16. An electric circuit arrangement as claimed in claim 1 wherein said capacitor coupling means connects the capacitor directly to the electrodes of the discharge lamp.

17. A circuit for starting and operating a discharge lamp comprising: an inductor, a controlled semiconductor switch, means for connecting a discharge lamp, said inductor and said semiconductor switch in a series circuit, means for applying to said series circuit a pulsatory direct voltage comprising a full-wave rectified voltage derived from a low frequency sinusoidal AC voltage, a first rectifier connected in parallel with a part of said series circuit that includes the discharge lamp but excludes the semiconductor switch, a capacitor connected in parallel with the discharge lamp, and a control circuit for supplying high-frequency switching pulses to a control electrode of the semiconductor switch thereby to switch the semiconductor switch at a frequency much higher than the frequency of the pulsatory direct voltage, and wherein the control circuit, in the operating condition of the lamp, switches the semiconductor switch off when the pulsatory direct voltage is at a minimum voltage level and switches the semiconductor switch on when the instantaneous value of the voltage of the pulsatory direct voltage exceeds the lamp operating voltage and is 0.5 to 0.8 times the then required lamp reignition voltage.

18. A circuit as claimed in claim 17 further comprising a timing circuit responsive to the pulsatory direct voltage to control the control circuit so that, prior to ignition of the lamp, the control circuit applies a switching pulse to the control electrode of the semiconductor switch to switch the semiconductor switch from cut-off into conduction when the instantaneous value of the pulsatory direct voltage is approximately a maximum, said inductor and capacitor then being operative via the conductive semiconductor switch to produce a transient response so as to develop a voltage across the capacitor greater than the maximum voltage of the pulsatory direct voltage.

* * * * *